US005921631A

United States Patent [19]

Bush

[11] Patent Number: 5,921,631

[45] Date of Patent: Jul. 13, 1999

[54] DEMOUNTABLE CHAIR CONSTRUCTION

[76] Inventor: Alfred Bush, 455C Albany Post Rd., Croton-on-Hudson, N.Y. 10520

[21] Appl. No.: 09/053,221

[22] Filed: Apr. 1, 1998

Related U.S. Application Data

[63] Continuation-in-part of application No. 29/068,982, Apr. 24, 1997.

[51] Int. Cl.[6] ..... A47C 7/00

[52] U.S. Cl. ..... 297/440.1; 297/440.13; 297/440.14

[58] Field of Search ..... 297/440.1, 440.13, 297/440.14

[56] References Cited

U.S. PATENT DOCUMENTS

| | | | |
|---|---|---|---|
| 2,279,864 | 4/1942 | Eide | 297/440.13 |
| 2,334,912 | 11/1943 | Eide | 297/440.13 X |
| 2,418,731 | 4/1947 | Seitz | 297/440.13 X |
| 2,479,086 | 8/1949 | Silverman | 297/440.13 |
| 2,486,987 | 11/1949 | Scarlett | 297/440.13 |
| 2,518,955 | 8/1950 | Stelzer | 297/440.13 |
| 2,534,413 | 12/1950 | Cenis | 297/440.13 |
| 2,672,181 | 3/1954 | Rose | 297/440.13 |
| 2,825,101 | 3/1958 | Rubenstein | 297/440.13 X |
| 3,788,700 | 1/1974 | Wartes | 297/440.13 |
| 4,082,356 | 4/1978 | Johnson | 297/440.13 |
| 4,140,065 | 2/1979 | Chacon | 297/440.13 X |
| 4,191,113 | 3/1980 | Hogberg | 297/440.14 X |
| 4,593,950 | 6/1986 | Infanti | 297/440.13 X |
| 5,000,514 | 3/1991 | Hanson | 297/440.13 |
| 5,605,378 | 2/1997 | Oyediran | 297/440.13 |
| 5,765,922 | 6/1998 | Hsia | 297/440.1 |
| 5,803,548 | 9/1998 | Battle | 297/440.13 |

*Primary Examiner*—Peter M. Cuomo
*Assistant Examiner*—Rodney B. White

[57] ABSTRACT

Disclosed is a demountable chair construction. The chair generally includes a plurality of planar support components which, when assembled, provide a flexible, comfortable seat and backrest. In its broadest context, the chair includes both forward and rearward members which together interconnect two side support components. In the preferred embodiment, each of the components is formed from a laminated material. The interconnection between these components, as well as their material construction, provides a certain degree of resilience to the thin laminate seat and back of the chair. Such resilience allows for comfortable of movement of both the seat and seatback, and a rigidity to the support and stretcher components.

5 Claims, 5 Drawing Sheets

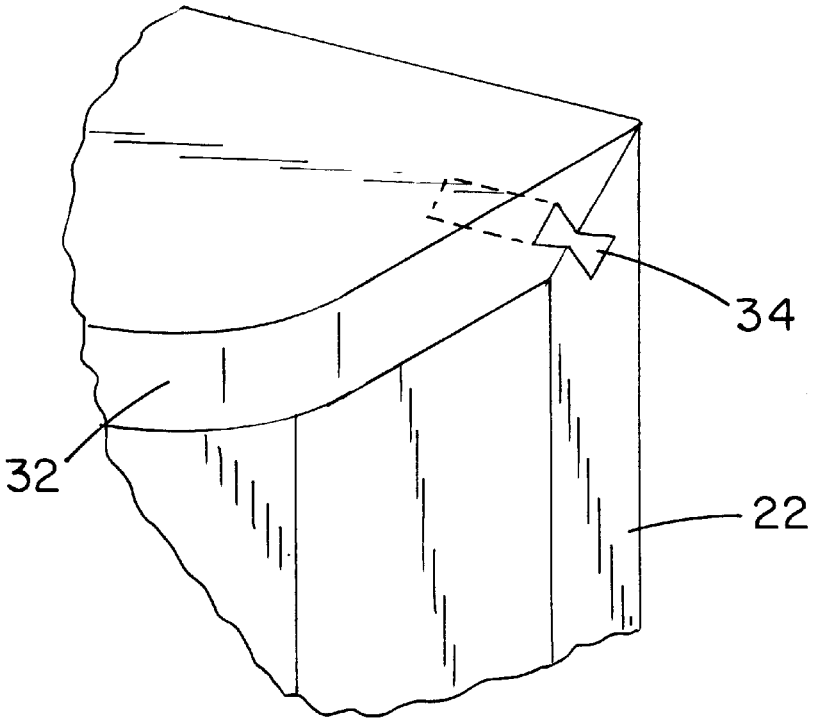
FIG 3
FIG 4
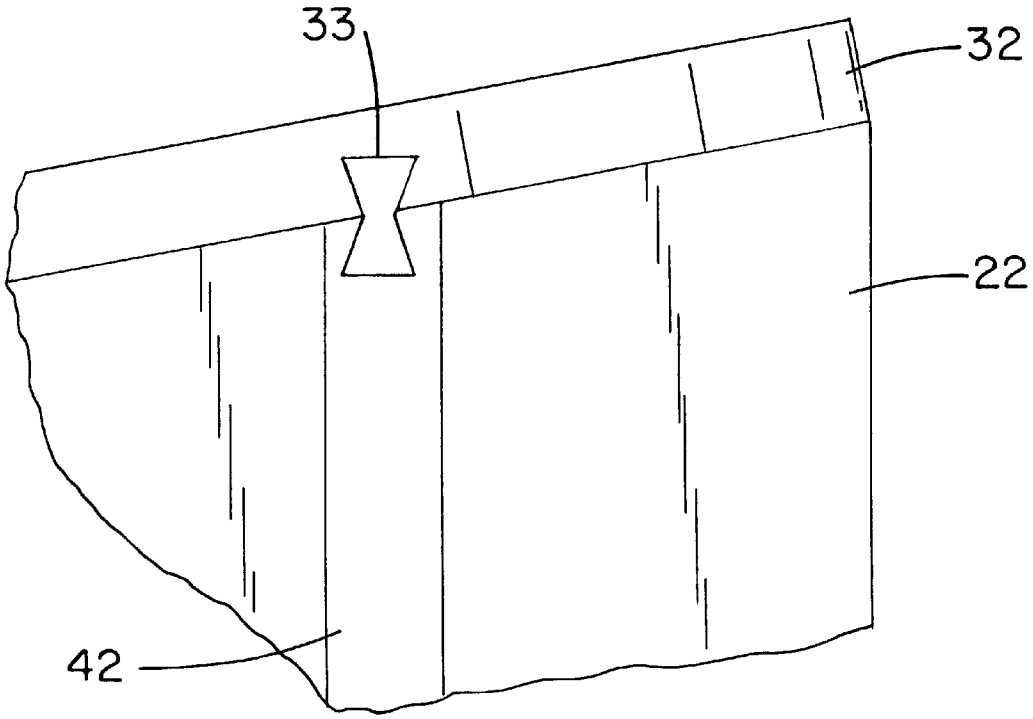

FIG 6
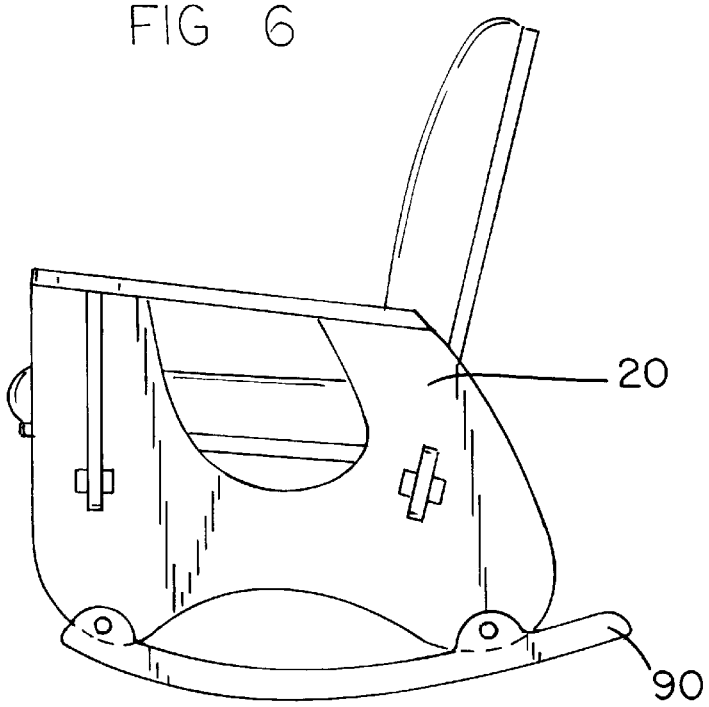
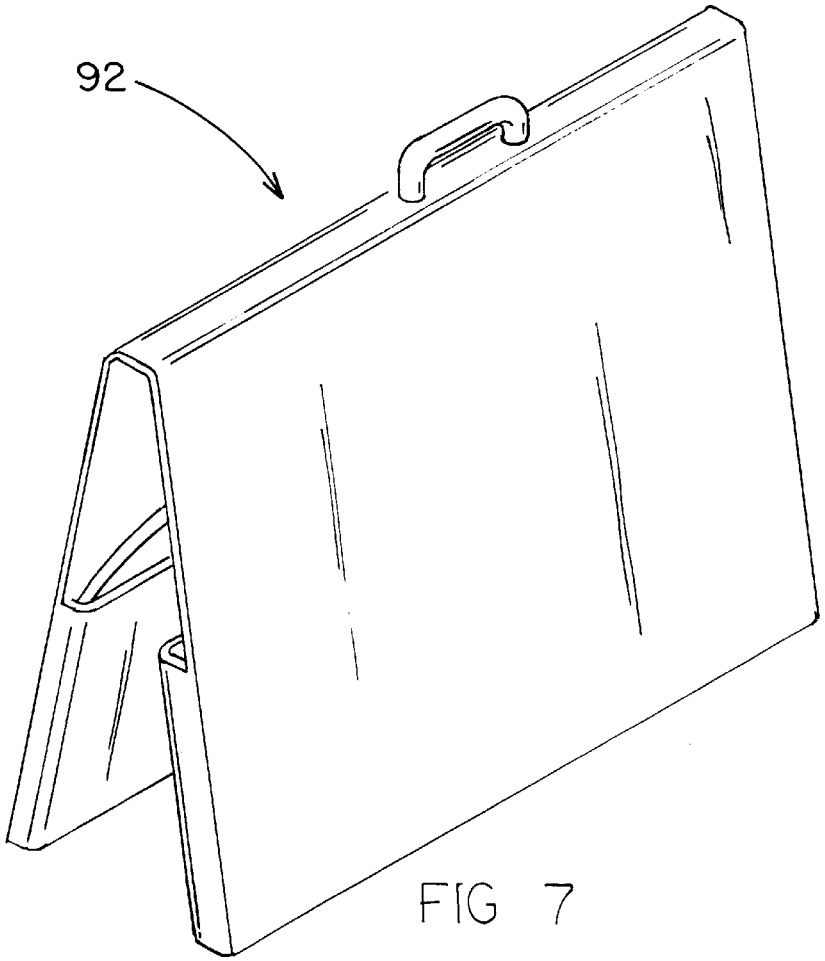
FIG 7

DEMOUNTABLE CHAIR CONSTRUCTION

RELATED APPLICATION DATA

This is a Continuation-In-Part of co-pending application Ser. No. 29/068,982 filed Apr. 24, 1997, incorporated he)rein by reference.

BACKGROUND OF THE INVENTION

1. Field of the Invention

The present invention relates to a demountable chair and more particularly pertains to such a chair with inherent flexibility, ease of assembly and low cost.

2. Description of the Prior Art

The use of knock down chairs is known in the prior art. Such knock down chairs, however, are known to consist basically of familiar, expected and obvious structural configurations.

By way of example: U.S. Pat. No. 4,712,837 to Swilley discloses a chair with multiple interlocking components; U.S. Pat. No. 5,275,467 to Kawecki discloses a knockdown chair construction; U.S. Pat. No. 299,087 to Pressly discloses a carpet stretcher; U.S. Pat. No. 4,919,485 to Guichon discloses a seat constructed from interlocking elements; U.S. Pat. No. 3,909,064 to Payne discloses a knockdown rocking chair; and U.S. Pat. No. 5,082,329 to Mars discloses a knock down chair construction.

Thus, in many respects, the demountable chair of the present invention substantially departs from the conventional concepts and designs of the prior art, and in so doing provides an apparatus primarily developed for the purpose of providing a chair with inherent resiliency. The present invention, therefore, substantially fulfills a continuing need for improved chair designs.

SUMMARY OF THE INVENTION

In view of the foregoing disadvantages inherent in the known types of knock down chairs now present in the prior art, the present invention provides a demountable chair which incorporates spring components. As such, the general purpose of the present invention, which will be described subsequently in greater detail, is to provide a chair which can be disassembled and easily stored, and transported.

To attain this, the present invention essentially comprises a demountable chair construction. The chair generally includes a plurality of planar support, or frame, components which, when assembled, provide a comfortable seat and backrest. In its broadest context, the chair includes both forward and rearward members which together interconnect two side support components. In the preferred embodiment, each of the components is formed from a laminated material. The interconnection between these components, as well as their material construction, provides a certain degree of resilience to the chair. Such resilience allows for limited flexible movement of both the seat and seatback.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction,and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved demountable chair with inherent flexibility and resiliency.

It is another object of the present invention to provide a demountable chair with interchangeable components.

It is a further object of the present invention to provide a chair which can easily be converted into a rocking chair.

An even further object of the present invention is to provide a demountable chair which is susceptible of a low cost of manufacture with regard to both materials and labor, and which accordingly is then susceptible of low prices of sale to the consuming public, thereby making such demountable chairs economically available to the buying public.

Still another object of the present invention is to provide a chair which alters itself in response to the application of body weight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a detailed view taken from FIG. 1.

FIG. 4 is a detailed view taken from FIG. 2.

FIG. 6 is a view of the assembled chair employing detachable rocker elements removably secured to the side supports of a modified design.

FIG. 7 is a view of a carrying case for use in transporting a disassembled chair.

Similar reference characters refer to similar parts throughout the several views of the drawings.

DESCRIPTION OF THE PREFERRED EMBODIMENT

Figure 1:
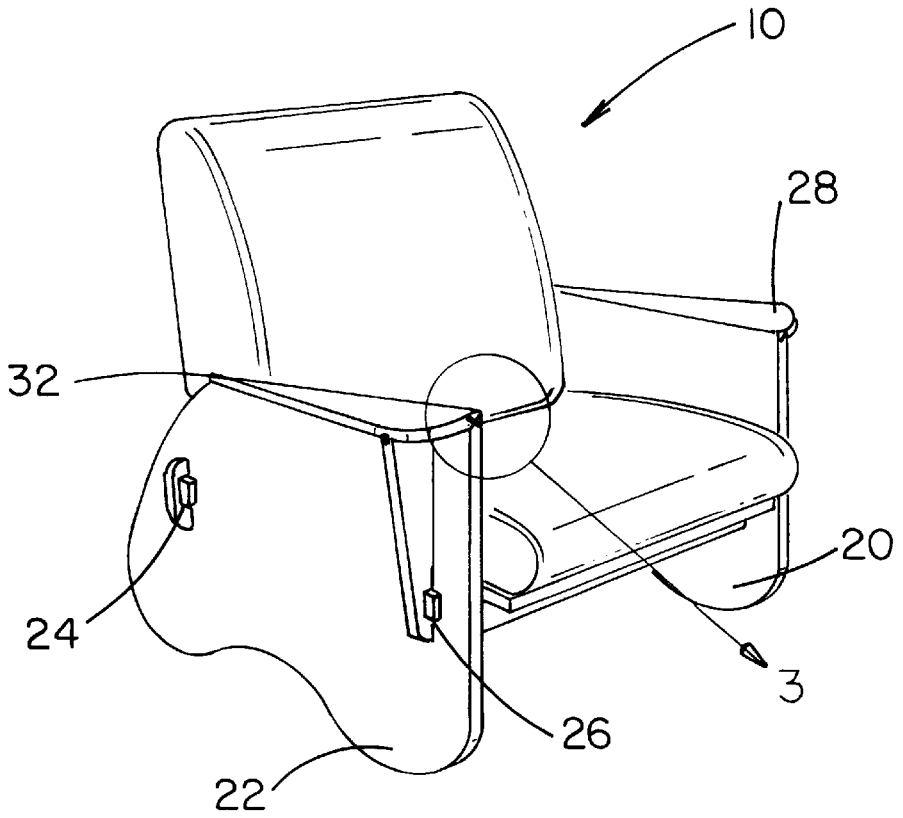
FIG. 1 is a perspective view of the assembled chair, including cushions, in accordance with the principles of the present invention.

With reference now to the drawings, and in particular FIG. 1 thereof, the demountable chair construction 10 of the present invention is depicted. The chair generally includes a plurality of planar frame components which, when assembled, provide a comfortable flexible seat and backrest. In its broadest context, the chair includes both forward and rearward members which together interconnect two side support components. In the preferred embodiment, each of the components is formed from thin laminated materials. The interconnection between these components, as well as their material construction, provides a certain degree of resilience to the entire chair. Such resilience allows for limited movement of both the seat and seatback. The various components of the present invention, and the manner in which they interrelate,will be described in greater detail hereinafter.

Figure 2:
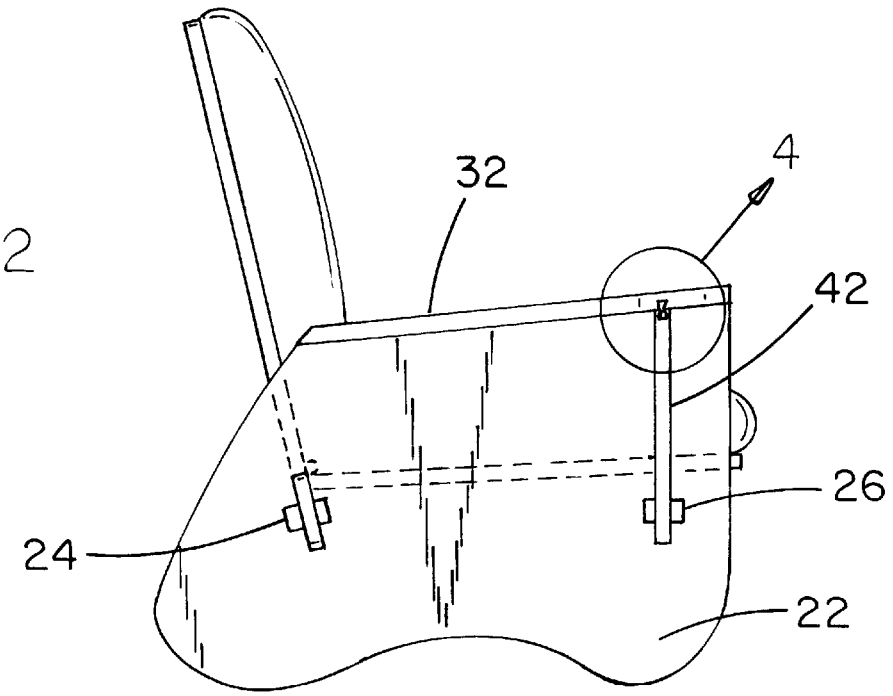
FIG. 2 is a side view of the assembled chair.

The first and second side frame support components (20 and 22 respectively) of the present invention are most clearly illustrated in FIG. 1. The first and second support components are of identical construction. Such support components are defined by upper and lower extents. Each side support, as illustrated in FIG. 2, also includes a rearward aperture 24 formed proximate its rearward portion, and a forward aperture 26 formed proximate its forward portion. Additionally, a pair of apertures 27, in the preferred embodiment as depicted in FIG. 6, are formed within each side portion at a lower extent. These rearward, forward and lower apertures aid in interlocking the various components of the present invention in a manner described more fully hereinafter.

Additionally, the chair of the present invention employs first and second arm rest components (28 and 32 respectively). Each of these arm rest components is adapted to be joined rigidly to an upper extent of one of the side support components. More specifically, a spline element 34, depicted in FIG. 4, is employed in rigidly joining an arm rest component 28 to a corresponding side support component 20. FIG. 4 illustrates the dovetailed interrelationship between the spline, arm rest and side support component. Such interrelationship enables the armrest to be rigidly secured to a side support. Although only one such spline is illustrated additional splines may be included to give greater support to the armrest/side component joint.

Figure 5:
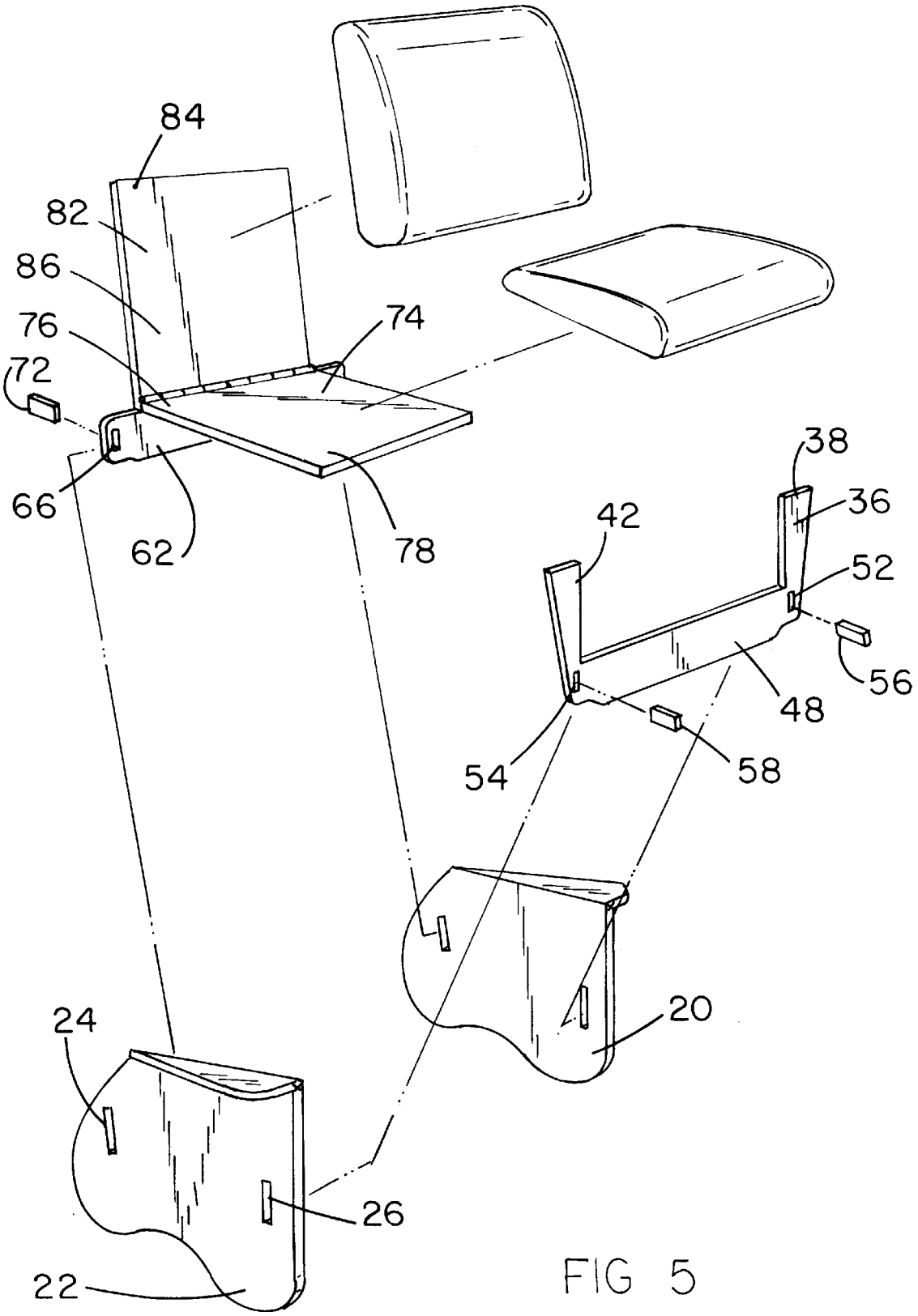
FIG. 5 is an exploded view of the chair illustrating the U-shaped spacer and rearward stretcher.

The two side support components are interconnected by way of a U-shaped spacer component arm 36 and a rectangular stretcher component 62. The U-shaped spacer component arm 36, as illustrated in FIG. 5, is defined by first and second upstanding arms (38 and 42 respectively), first and second elbow regions (44 and 46 respectively) and an intermediate spacer extent 48 which joins the elbow regions. Additionally, a first aperture 52 is formed within the first elbow region 44, and a second aperture 54 is formed within the second elbow region 46. As indicated, this spacer component is specifically adapted to interconnect to the first and second side support components. Such interconnection is achieved by way of the forward apertures 26 within each of the side support components. More specifically, the first upstanding arm 38 of the spacer 36 is adapted to be positioned through the forward aperture of the first side support component 20. In a similar fashion, the second upstanding arm 42 is adapted to be positioned through the forward aperture of the second side support component 22. Each of the upstanding arms, when so positioned, is thereafter connected to its corresponding arm rest. More specifically,each upstanding arm is connected to the armrest via a removable spline 33. The interrelation between the upstanding arm, armrest and spline is illustrated with reference to FIG. 3.

The spacer component is maintained in position by way of a pair of wedges. Namely, a first wedge 56 is positioned within the aperture of the first elbow region 44, and a second wedge 58 is positioned within the aperture of the second elbow region 46. FIG. 5 is an exploded view illustrating exactly how the second wedge 58 is inserted into the aperture of the U-shaped arm member 36. Thus, the wedges, when inserted, function to interlock the U-shaped spacer and side support components.

Additional interconnection between the side support is provided by the rear rectangular stretcher component 62. Such stretcher component 62 is defined by a first end with an aperture 64 formed therethrough, and a second end with an aperture 66 formed therethrough. The first end of the rectangular stretcher component is adapted to be positioned within the rearward aperture of the first side support component 20. Similarly, the second end of the rectangular stretcher component is adapted to be positioned within the rearward aperture of the second side support component 22. Wedges are employed in keeping the rectangular stretcher component in place. More specifically, a first wedge 68 is positioned within the aperture of the first end of the stretcher component 62. In a similar manner, a second wedge 72 is positioned within the aperture of the second end of the stretcher component 62. Thus, these wedges interlock the stretcher and side support components together. FIG. 5 is an exploded view illustrating one of the wedges being positioned within the second aperture of the rectangular stretcher.

The chair surfaces are created through an essentially thin seat component 74 and seatback component 82. The planar seat 74 component is defined by a rearward portion 76 and a forward portion 78. The rearward portion 78 of the seat component 74 is adapted to be hingedly interconnected to the rectangular stretcher component 62, and to the seatback component 82. With the seat component so connected, the forward portion 78 of the seat 74 rests upon the intermediate extent of the U-shaped stretcher 48. It is this interrelationship that provides the chair with a degree of resiliency. More specifically, when a user sits upon the seat their weight is transferred to the U-shaped spacer 36 and the rear stretcher 62. The U-shaped spacer in turn, is rigid. Thus, the seat and seatback components 82 can flex and recline respectively upon application of a user's weight. A similar rigidity is provided by the rectangular stretcher component 62.

The planar seat back 82 component is defined by both an upper extent 84 and a lower extent 86. The lower extent 86 of the seatback 82 is adapted to be rigidly interconnected with the rectangular stretcher component 62. The connection between the rectangular stretcher 62 and seat 74, as well as between the rectangular stretcher 62 and seatback 82, can be achieved in a number of ways such as through a hinge and adhesive arrangement respectively. Additionally, once the chair is assembled, a seat cushion can optionally be secured over the seat component via a flap. Similarly, a seat cushion is also adapted to be secured over the seatback component. The seat cushions may be preferably attached at their juncture.

An essential feature of the present invention is the interchangability of the support frame components. Namely, a user can uncouple the chair components and thereafter replace the side support components. Thus, a user can change between the side support components illustrated in FIG. 1 and the side support components illustrated in FIG. 6. These side support components are just a few examples of the wide variety of side support designs and construction uses that could be employed.

Additionally, the side support components, in the preferred embodiment, include apertures formed at their lower extents. Such apertures allow for the securement of detachable runners. Such runners are illustrated with reference to FIG. 6. Each runner is arcuate in shape with enlarged forward and rearward portions. Each of these forward and rearward portions includes an aperture. These apertures are spaced so-that they can be placed in alignment with the apertures of the side support components. Fasteners are then employed to removably secure each runner to its corresponding side support component.

The resiliency within the assembled seat and back of the chair is also created by way of varying the use of materials. In the preferred embodiment, each of the components is constructed entirely from varied laminations of thin sheet material. Such laminated materials have the requisite degree of flexibility. additionally, the required flexibility is achieved by ensuring that each of the components is of a relatively planar configuration. Also, by providing planar component parts the disassembled chair can easily be assembled, stored, transported, and manufactured.

Figure 8:
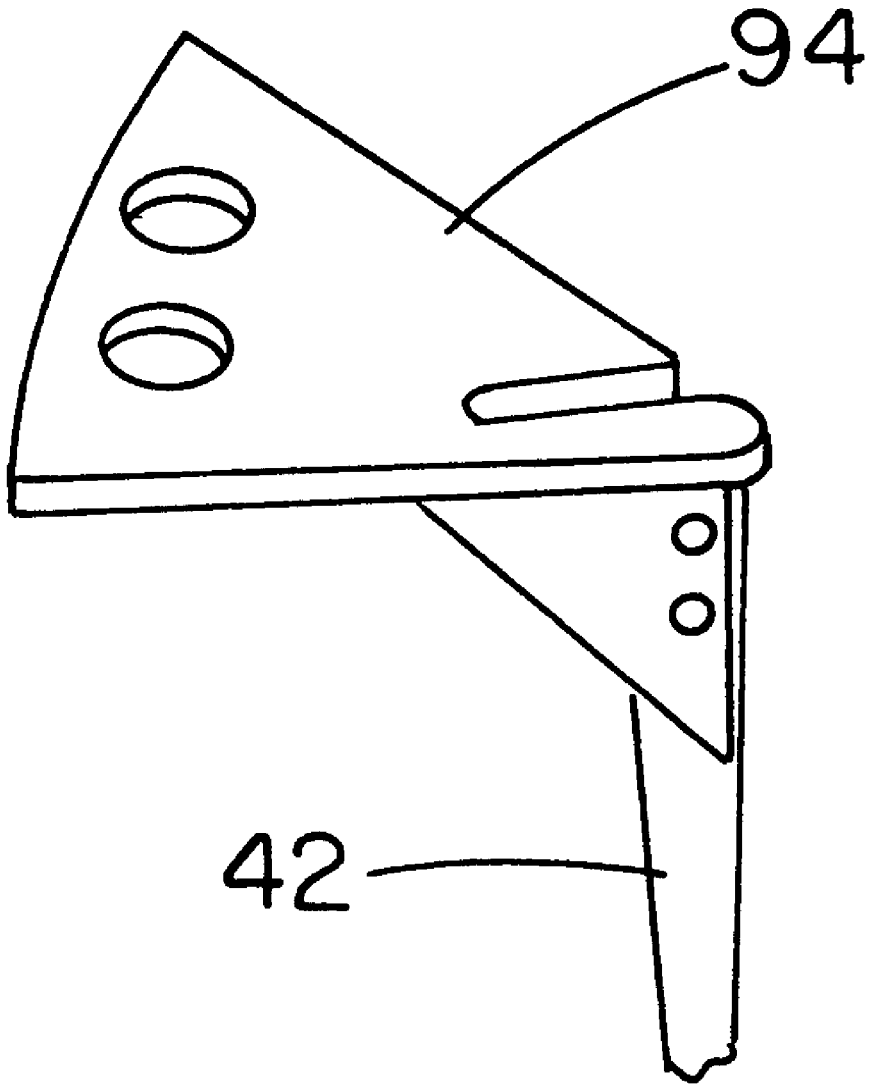
FIG. 8 is a perspective view of an attachable tray.

FIG. 7 illustrates a carrying case 92 for use in transporting the disassembled chair of the present invention. Such carrying cases included internal flaps into which the various components of the chair can be positioned. Lastly, FIG. 8 depicts a removable tray 94 which can be attached to one of the upstanding arms 42 of spacer 36. Such tray 94 is secured to the upstanding arm 42 and includes a horizontal support surface. A plurality of beverage holder can also be form into this horizontal support. Additionally, the horizontal support includes a slot for receiving the upper extent of the upstanding arm.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A demountable chair construction comprising in combination:

first and second side support components, each support component having an upper extent, a lower extent, a rearward aperture formed proximate a rearward portion, and a forward aperture formed proximate a forward portion, a pair of apertures formed within each side portion at the lower extent;

first and second arm rest components, each of the arm rest components adapted to be joined to the upper extent of one of the side support components, each arm rest component being joined to a corresponding side support component via a spline;

a U-shaped component being defined by first and second upstanding arms, first and second elbow regions and an intermediate extent intermediate the elbow regions, a first aperture formed within the first elbow region and a second aperture formed within the second elbow region, the component adapted to be interconnected to the first and second side support components by way of the forward apertures, with the first upstanding arm being positioned through the forward aperture of the first side support component and the second upstanding arm being positioned through the forward aperture of the second side support component, a first wedge positioned within the aperture of the first elbow region and a second wedge positioned within the aperture of the second elbow region, the wedges interlocking the u-shaped component and side frame components;

a rectangular stretcher component having a first end with an aperture formed therethrough and a second end with an aperture formed therethrough, the rectangular stretcher component adapted to be interconnected to both the first and second side support components, with the first end of the rectangular stretcher component being positioned within the rearward aperture of the first side frame component and the second end of the rectangular stretcher component being positioned within the rearward aperture of the second side support component, a first wedge positioned with the aperture of the first end of the stretcher component and a second wedge positioned within the aperture of the second end of the stretcher component, the wedges interlocking the stretcher and side support components;

a planar seat component having a rearward portion and a forward portion, the rearward portion being interconnected to the rectangular stretcher component, with the forward portion resting on the intermediate extent of the U-shaped component;

a planar seat back component having an upper extent and a lower extent, the lower extent being interconnected with the rectangular stretcher component.

2. A demountable chair construction comprising in combination:

first and second side support components, each support component having an upper extent, a lower extent, a rearward aperture formed proximate a rearward portion, and a forward aperture formed proximate a forward portion, a pair of apertures formed within each side portion at the lower extent;

a U-shaped spacer component being defined by first and second upstanding arms, first and second elbow regions and an intermediate extent intermediate the elbow regions, a first aperture formed within the first elbow region and a second aperture formed within the second elbow region, the spacer arm components adapted to be interconnected to the first and second side support components by way of the forward apertures, with the first upstanding arm being positioned through the forward aperture of the first side support component and the second upstanding arm being positioned through the forward aperture of the second side support component, a first wedge positioned within the aperture of the first elbow region and a second wedge positioned within the aperture of the second elbow region, the wedges interlocking the U-shaped spacer component and side frame components;

a rectangular stretcher component having a first end with an aperture formed therethrough and a second end with an aperture formed therethrough, the rectangular-stretcher component adapted to be interconnected to both the first and second side support components, with the first end of the rectangular stretcher component being positioned within the rearward aperture of the first side support component and the second end of the rectangular stretcher component being positioned within the rearward aperture of the second side frame component, a first wedge positioned with the aperture of the first end of the stretcher component and a second wedge positioned within the aperture of the second end of the stretcher component, the wedges interlocking the stretcher and side support components;

a planar seat component having a rearward portion and a forward portion, the rearward portion being interconnected to the rectangular stretcher component, with the forward portion resting on the intermediate extent of the U-shaped spacer;

a planar seat back component having an upper extent and a lower extent, the lower extent being interconnected with the rectangular stretcher component.

3. The demountable chair construction as described in claim 2 further comprising:

first and second arm rest components, each of the arm rest components adapted to be joined to the upper extent of one of the side support components, each arm rest component being joined to a corresponding side support component via a spline.

4. The demountable chair construction as described in claim 2 wherein:

each of the components is constructed entirely from a thin laminated material.

5. The demountable chair construction as described in claim 2 wherein:

each of the components is relatively planar.

* * * * *